United States Patent [19]

Golden

[11] Patent Number: 4,732,345

[45] Date of Patent: Mar. 22, 1988

[54] HOSE REEL

[76] Inventor: Sammy L. Golden, 306 S. Fig, Sweeny, Tex. 77480

[21] Appl. No.: 925,742

[22] Filed: Oct. 30, 1986

[51] Int. Cl.[4] ..... B65H 75/38

[52] U.S. Cl. ..... 242/86; 137/355.27; 242/67.1 R; 242/106

[58] Field of Search ..... 242/86, 86.1, 86.2, 242/86.3, 86.4, 86.5 R, 86.52, 96, 106, 129.6, 129.62, 60, 62, 67.1 R, 68.4; 137/355.12, 355.19, 355.26, 355.27

[56] References Cited

U.S. PATENT DOCUMENTS

| | | | |
|---|---|---|---|
| 112,656 | 3/1871 | Vincent | 242/106 |
| 437,554 | 9/1890 | Bellamy | 242/60 |
| 720,141 | 2/1903 | Hayes | 242/68.4 |
| 1,827,171 | 10/1931 | Schneider | 242/62 |
| 1,940,165 | 12/1933 | Garretson | 242/129.6 X |
| 2,869,800 | 1/1959 | Eden | 242/86 |
| 3,958,772 | 5/1976 | Hynson | 242/86.5 R |

FOREIGN PATENT DOCUMENTS

| | | | |
|---|---|---|---|
| 58901 | 3/1924 | Sweden | 242/86 |
| 532978 | 2/1941 | United Kingdom | 242/86 |

*Primary Examiner*—John M. Jillions
*Attorney, Agent, or Firm*—Glwynn R. Baker

[57] ABSTRACT

A hose reel is described which permits hoses to be reeled in sections and removed from the apparatus for storage, testing, etc., in the rolled condition, the reel is designed to reel hoses, be they of a flattened nature when not in use, as for example a fire hose, or a more rigid form, such as for example a hose for delivering air or liquids, such as water or hydrocarbons, or hoses such as suction hoses, and consists of a reel a U-shaped configuration mounted on a stand or a hanger, as on the back of a truck, which U is expandable to accommodate various width hoses of different construction and permit the roll of hose to be removed from the apparatus in its rolled condition.

6 Claims, 5 Drawing Figures

HOSE REEL

BACKGROUND OF THE INVENTION

Hose reels have been around for many years. Often these reels have axles to which the hose coupler is fastened and through which the source of fluid to be passed through the hose is delivered. A few have been motorized, as for example the semi-rigid hoses used to deliver hydrocarbon fuels, air and the like or suction hoses.

In so far as is known, no hose reel has been described which will accommodate the rolling up of, for example a section of fire hose or air hose between couplings, and will permit the so rolled hose to be removed from the reel in its rolled condition. Such a reel would materially reduce the physical exertion of the fire fighter, as well as, provide the hose section in rolled condition for easier movement to the truck bed for transportation to the drying racks, for example. Similarly, when a hose needs to be pressure tested, the hose sections can be readily rolled and transported either before and/or after such testing. In the instance of high pressure air hoses, some of which are 50 to 100 feet per section and usually carried as sections to be assembled at the job site, less physical labor is expended in rolling the sections for such transport.

BRIEF DESCRIPTION OF THE INVENTION

A hose reel is described which permits hoses to be reeled in sections and removed from the apparatus for storage, testing, etc., in the rolled condition. The reel is designed to reel hoses, be they of a flattened nature when not in use, as for example a fire hose, or a more rigid form, such as for example a hose for delivering air or liquids, such as water or hydrocarbons, or hoses such as suction hoses. Basically the reel consists of a U-shaped member mounted on a stand or a hanger, as on the back of a truck, which U is expandable to accommodate various width hoses of different construction and permit the roll of hose to be removed from the apparatus in its rolled condition. Hose guide plates are provided within the U which retain the hose there between. Each such guide is independently mounted on a sleeve, each sleeve being rotatably positioned in bearing housings located at the open end of the U-shaped member. A means is associated with the these sleeves to rotate at least one of the sleeves and its attached guide. Conveniently, a rotatable shaft is positioned across the apparatus through the sleeves extending from exterior of one bearing housing and its sleeve into the other sleeve in its bearing housing, providing in addition to a means to rotate the guide(s) an axle upon which the hose may be rolled. The shaft is provided with a means, as for example a handle or a rotating power source, for rotating the shaft. The shaft means, if used, is provided with a suitable means for securing one end of the hose section to be rolled. In another embodiment each guide is provided with a indent to accommodate the lugs or ears normally found on such couplings to secure the hose end in the apparatus.

The U-shaped member is provided with adjustment means in the cross bar member of the U to enable the apparatus to accommodate various width hoses and in the case of the shaft-less version, the one containing the indents in the guide elements to accommodate the lugs of a coupling, a means to increase the width between the guides to facilitate the engagement and release of the hose lugs from the guide indents and thus enable preparation for winding as well as removal of the hose in its rolled condition from the apparatus.

The motive force for rotating the shaft may be manual, as by a handle, or may be mechanical means, as for example, an electric motor or internal combustion engine.

Various means for securing the ends of a section of hose are contemplated, as for example providing a slot in the shaft upon which the hose is to be rolled to permit the hose to be inserted at its coupling thus fixedly securing the end to the rotating shaft to hold the hose securely during reeling.

In the instance where the shaft is used, the shaft upon being withdrawn allows the rolled hose to be removed in its rolled condition from the apparatus. Various means for securing the roll are contemplated, such as straps, to maintain the rolls integrity upon removal from the apparatus.

Another means for securing the coupling end of the hose is the aforedescribed slots in the guides at an axial location and into which the lugs or ears of a coupling such as found on fire hose couplings will fit, and drawing the guides together against the coupling to secure the lugs in the holes.

Still another means of securing the hose end onto the reel is that particularly suitable for semi-rigid hoses, wherein a drum is secured onto the shaft or to one of the guides. The drum is designed to accommodate these style hoses which cannot tolerate any sharp bends without some damage. The drum can have lugs extending radially to receive the coupling therebetween at one end of the drum and which are retractable so that the hose can be removed in the rolled position. Other coupling means will be apparent to those skilled in the art.

DETAILED DESCRIPTION OF THE INVENTION

Figure 1:
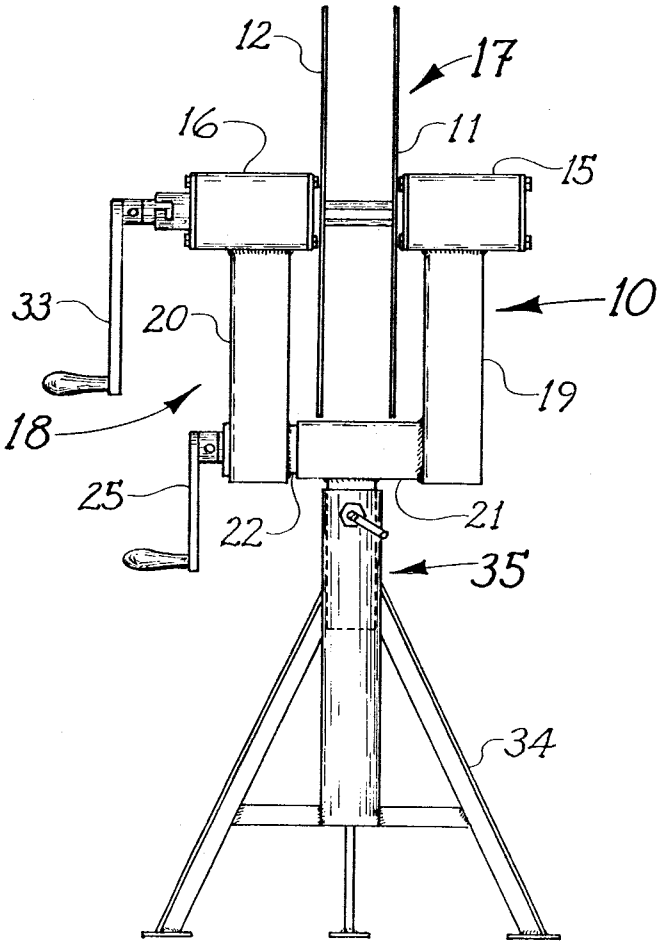
FIG. 1 represents a front view of the hose reel of the present invention.
Figure 2:
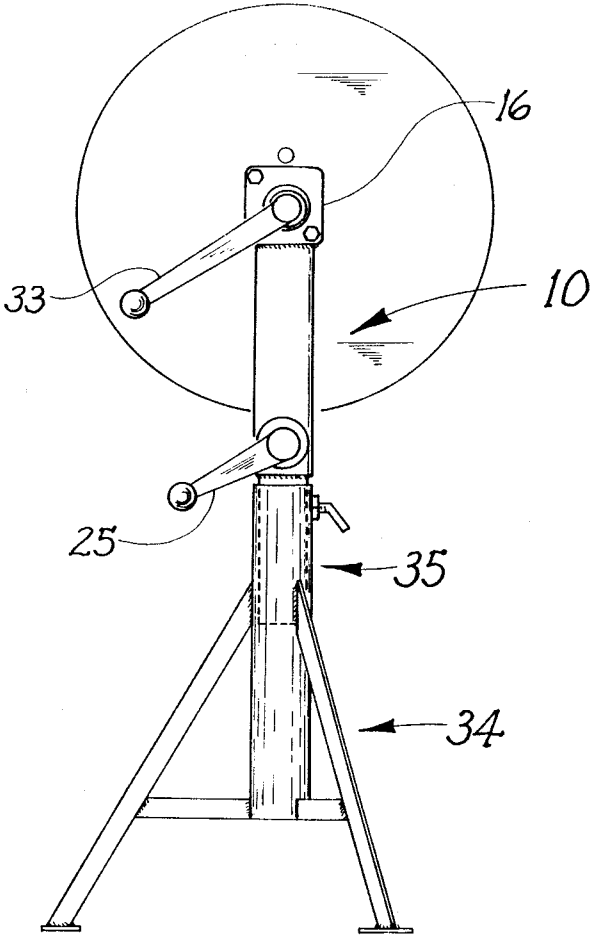
FIG. 2 represents a side view of the hose reel.
Figure 4:
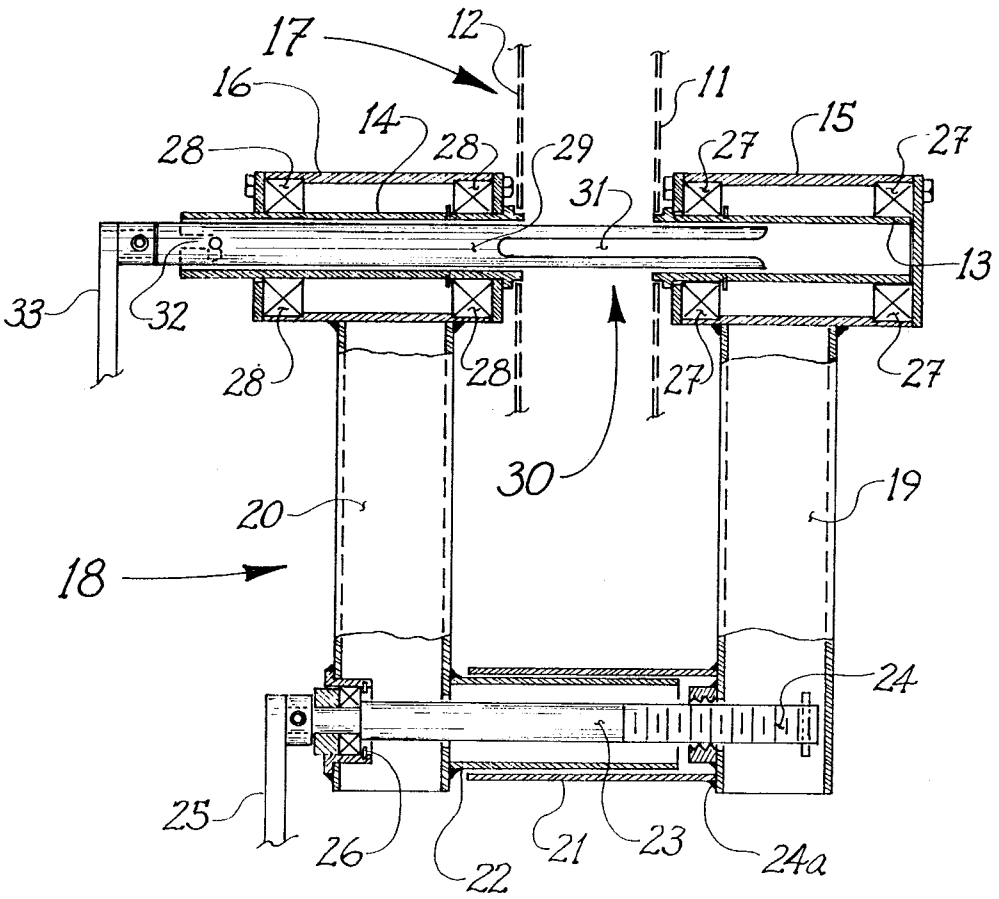
FIG. 4 represents, in partial section, the reel axle and hose support means.
Figure 3:
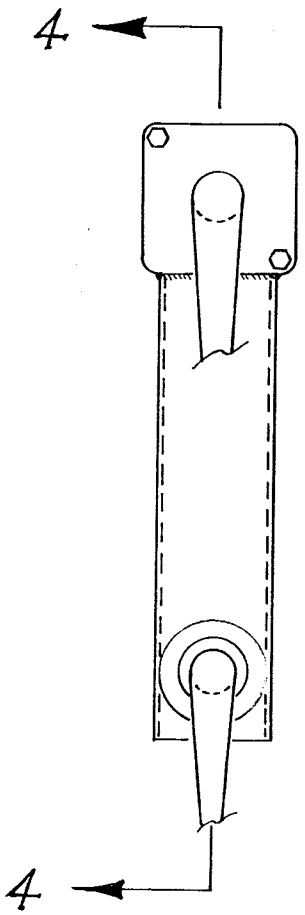
FIG. 3 represents a partial view of the reel operating mechanism.
Figure 5:
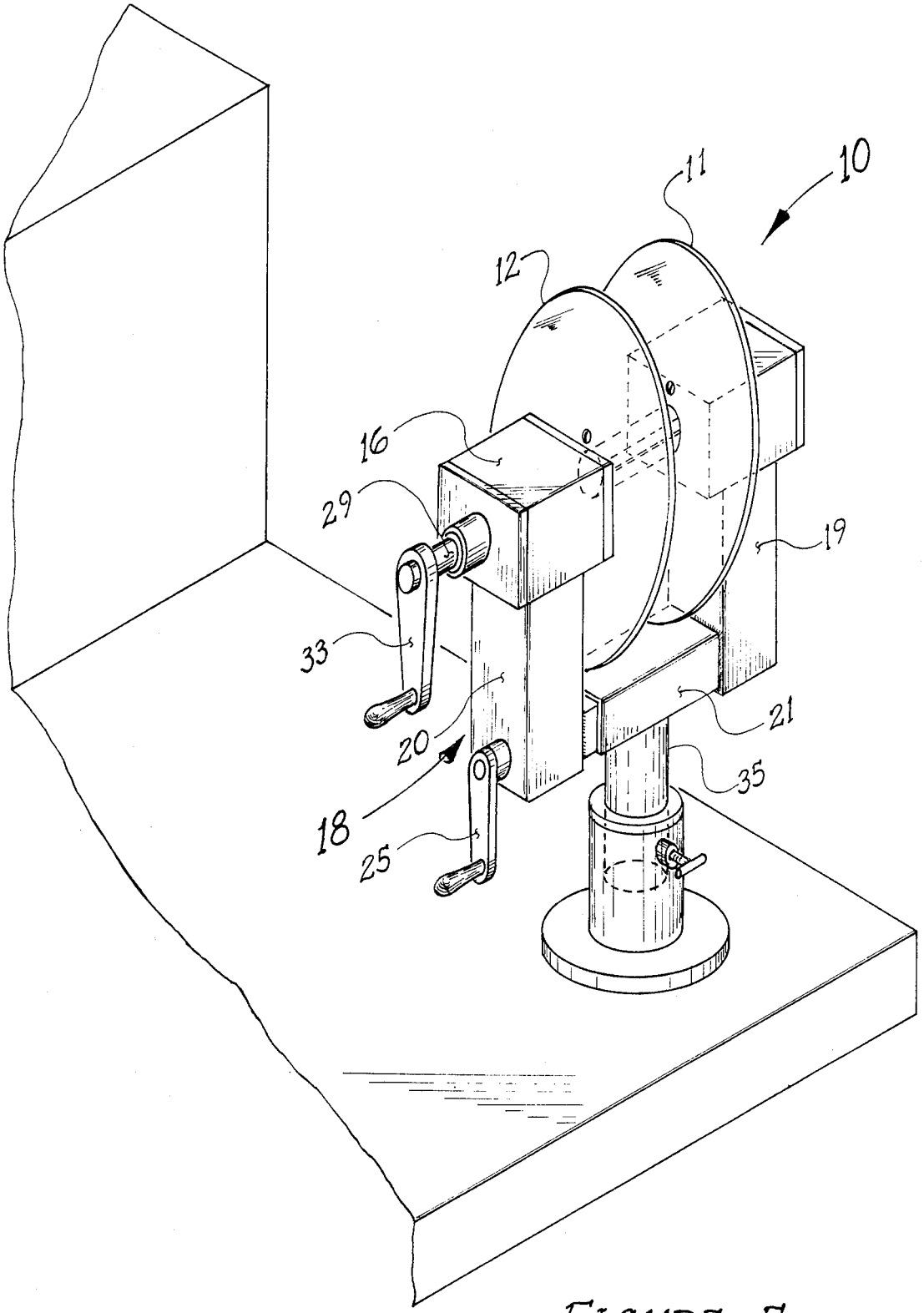
FIG. 5 illustrates an one means for mounting the hose reel on the rear of a truck.

With particular reference to the drawing, hereafter is described a hose reel for winding a section of a hose, e.g. a fire hose, which permits the wound hose section to be removed in the wound or coil form from the apparatus for storage or ease of handling. The hose reel (10) comprises a pair of circular or extending arms to provide a restraint for layers of the hose, referred to as hose guide plate members (11 and 12) each mounted and attached to a sleeve (13 and 14), respectively. The sleeves are rotatably mounted, one each into opposite bearing housings (15 and 16) located at the open end (17) of a U-shaped member (18). The U-shaped member (18), illustrated as a square or box design, although any shape material may be used so long as a means is provided for axial alignment of the open ends, is comprised of a pair of L-shaped members (19 and 20), the short legs (21 and 22, respectively) of which are slidably engagable one into the other, forming the bottom bar of the U-shaped member. The short legs (21 and 22) are adjustably movable with relation to each other in a lateral direction by providing a rotatable shaft (23) having a threaded end (24) engaging a mating threaded element (24*a*) secured to or within the leg (21), the other end of the shaft (23) extends through the other leg (22) and is provided with a handle (25). The handle end of the shaft is secured, as at (26), in a rotatable but restrained manner, illustrated as a retainer ring engaging a shoulder on the shaft, to enable the two L-shaped members to be moved apart and together thereby providing adjustment of the width of the reel to accommodate several widths of hose. This assembly is also provided with bearings to enable easy rotation of the shaft. A roller, not shown, may be positioned over the short legs to decrease the stress on the hose as it is drawn into the apparatus. Alternatively, the roller may be positioned above the short legs on a shaft which is long enough to remain across the U at its most extended position and yet more or less centrally adjust when the U is in its most contracted position.

The sleeves (13 and 14) are mounted in a rotatable manner through their respective bearing housing, each housing containing a bearing or pair of bearing (27 and 28, respectively). In the illustrated embodiment a shaft (29) passes through the sleeves (13 and 14), one end of which (30) is preferably provided with a slot (31) of a length to extend across the distance between the two bearing housing and act as a means to receive a flattened hose, which can be drawn to the coupling, securing the hose on the shaft (29). The other end of the shaft (29) extends exterior of its bearing housing which is shown to include a short slot (32) which engages a pin on a handle (33) to enable rotation of the shaft (29).

The entire assembly is illustrated as mounted on a stand (34), illustrated as a tripod, which may be provided with an adjustment means (35). It is of course to be understood that a hanger frame may replace the stand if the apparatus is to be mounted on a truck bed or the like.

The apparatus may be constructed of any suitable material, such as wood, metal of plastic, but preferably is constructed of metal, such as stainless steel, aluminum or magnesium, the latter two metals markedly reducing the weight of the apparatus. The apparatus may be made portable by placement of wheels on the frame, e.g. one wheel on each of two legs of the tripod stand. Welding of the component parts is preferred but screws and bolts and nuts may be used.

In a preferred operation, exemplifying the rolling of sections of a fire hose, the hose next to a coupling of the hose, as for example a fire hose, is inserted into the hose securing means of the shaft, such as the shaft legs or slot described above, by withdrawing the shaft, placing the flattened portion of the hose next to the free coupling into the slot as the shaft is reinserted into the sleeves. The motive force is activated, in this instance the handle is rotated, and the hose wound about the shaft within the guides. When the next coupling is reached, the rolled section is uncoupled and a band is preferably placed about the roll to maintain the integrity of the roll during subsequent handling. The shaft is withdrawn and the roll of hose is rolled from the apparatus. The hose of the next coupling is inserted into the slotted end of the shaft as it is reinserted into the sleeves and the procedure repeated until all of the sections have been rolled individually.

In another embodiment, referred to above, the necessity for a shaft is eliminated, the guides (11 and 12) each having an indent circumferentially positioned about the axis of rotation, to receive the ears or lugs of a coupling, such as the ears or lugs conventionally found on the couplings of fire hoses. The U is expanded in width to allow insertion of the lugs into the slot and then its width decreased to hold the coupling between the guides with the lugs extending into the indents. The width of the U is expanded when it is desired to remove the rolled hose.

It is often desirable to wind a semi-rigid hose, such as a hydrocarbon fuel delivery hose, or an air hose about a larger core or drum. This can be readily accomplished by placement of such a larger drum over a shaft, such as illustrated in the drawings, and securing the drum or the shaft to one of the guides so that it will rotate with the guide and shaft.

Various means can be employed to secure the hose coupling to rotate with such larger drums, such as providing a pair of radially extending retractable lugs spaced to accommodate the coupling and permitting the hose to follow the drum circumference without any severe stress being placed on the hose at the connection of the coupler to the hose body.

In summary the hose reel comprised of a U-shaped frame member consisting of a pair of L-shaped elements slidably matingly adjustably engagable one into the other forming the cross bar of the U-shaped member;

a pair of bearing housing members secured to the open end of the U, each housing containing friction reducing bearing members within;

a pair of sleeve members rotatably mounted on and axially supported by said bearings, one in each housing;

each said sleeve having secured thereto at the end which is internal of said U a hose guide member of a radius of about the depth of said internal dimension of said U;

a means for securing a hose coupling axially with respect to the axis of rotation of the guides between said guides;

a means to rotate at least one of said guides about its axis;

a means associated with the cross bar of said U to adjust the width of said U;

a means upon which said reel is mounted above the ground.

I claim:

1. A hose reel comprised of a U-shaped frame member consisting of a pair of L-shaped elements slidably matingly adjustably engagable one into the other forming the cross bar of the U-shaped member;

a pair of bearing housing members secured to the open end of the U, each housing containing friction reducing bearing members within;

a pair of sleeve members rotatably mounted within and axially supported by said bearings, one in each housing;

each such sleeve having secured thereto at the end which is internal of said U, a hose guide member of a radius of about the depth of said internal dimension of said U;

a rotatable withdrawable shaft extending across the width of the U and positioned through the sleeves, one end extending exterior of one of said bearing housings, the other end of said shaft extending into said other sleeve, said latter end being provided with a pair of legs which extend across the interior dimension of the U to accommodate a hose near its coupling, the other end of said shaft extending exterior of said housing being provided with a means for attachment of a source of power to rotate said shaft within said sleeves;

a means associated with the cross bar of said U to adjust the width of said U;

a means upon which said reel is mounted above the ground.

2. A hose reel as in claim 1 which is mounted on and height adjustable relative to a stand to maintain the apparatus above ground level.

3. A hose reel as in claim 1 wherein the means upon which said reel is mounted above ground comprises a bracket secured to the rear portion of a truck body in a pivotal manner.

4. A hose reel comprised of a U-shaped frame member consisting of a pair of L-shaped elements slidably matingly adjustably engagable one into the other forming the cross bar of the U-shaped member;

a pair of bearing housing members secured to the open end of the U, each housing containing friction reducing bearing members within;

a pair of sleeve members rotatably mounted within and axially supported by said bearings one in each housing;

each said sleeve having secured thereto at the end which is internal of said U, a hose guide member of a radius of about the depth of said internal dimension of said U, said guides each having an indent axially radially positioned from the axis of said member to receive ears or lugs of said coupling;

a means associated with the cross bar of said U to adjust the width of said U;

a means upon which said reel is mounted above the ground.

5. A hose reel as in claim 4 which is mounted on and height adjustable relative to a stand to maintain the apparatus above ground level.

6. A hose reel as in claim 4 wherein the means upon which said reel is mounted above ground comprises a bracket secured to the rear portion of truck body in a pivotal manner.

* * * * *